US005448224A

United States Patent [19]

Mochizuki

[11] Patent Number: 5,448,224

[45] Date of Patent: Sep. 5, 1995

[54] HEAT DETECTOR INCLUDING DEVICE FOR DETECTING ABNORMALITY OF EXTERNAL TEMPERATURE SENSOR

[75] Inventor: Mikio Mochizuki, Tokyo, Japan

[73] Assignee: Nohmi Bosai Ltd., Tokyo, Japan

[21] Appl. No.: 217,673

[22] Filed: Mar. 25, 1994

[30] Foreign Application Priority Data

Mar. 31, 1993 [JP] Japan ..... 5-096715

[51] Int. Cl.[6] ..... G08B 17/00

[52] U.S. Cl. ..... 340/589; 340/587; 340/584; 340/508; 374/30

[58] Field of Search ..... 340/584, 508, 587, 596, 340/599, 589; 374/10, 30, 45

[56] References Cited

U.S. PATENT DOCUMENTS

| | | | |
|---|---|---|---|
| Re. 28,915 | 7/1976 | Ogden et al. | 340/507 |
| 3,599,474 | 8/1971 | Brown | 374/30 |
| 3,715,923 | 2/1973 | Hornbaker | 374/30 |
| 3,765,238 | 10/1973 | Somikama | 374/30 |
| 3,973,257 | 8/1976 | Rowe | 340/511 |
| 4,901,061 | 2/1990 | Twerdochlib | 340/587 |
| 4,906,108 | 3/1990 | Geake | 374/30 |
| 4,922,230 | 5/1990 | Ohtani | 340/587 |
| 5,107,246 | 4/1992 | Mogaky | 340/587 |
| 5,140,305 | 8/1992 | Hurley | 340/587 |
| 5,172,099 | 12/1992 | Glaser | 340/587 |
| 5,198,801 | 3/1993 | Duggan et al. | 340/589 |

FOREIGN PATENT DOCUMENTS 3942252 2/1991 Germany .

OTHER PUBLICATIONS

Patent Abstracts of Japan, vol. 5, No. 32 (P-050) 27 Feb. 1981.

*Primary Examiner*—Brent Swarthout
*Assistant Examiner*—Albert K. Wong
*Attorney, Agent, or Firm*—Wenderoth, Lind & Ponack

[57] ABSTRACT

A heat detector includes an external temperature detector for detecting an external temperature outside the heat detector and an internal temperature detector for detecting an internal temperature inside the heat detector. A microcomputer calculates a temperature difference between the external temperature detected by the external temperature detector and the internal temperature detected by the internal temperature detector. The microcomputer monitors the above-described temperature difference to detect an event in which the temperature difference has remained greater than a predetermined value for a predetermined duration or longer. If the microcomputer detects that the temperature difference has remained greater than the predetermined value for the predetermined duration or longer, the microcomputer outputs an abnormal signal representing that the external temperature detector is abnormal.

10 Claims, 4 Drawing Sheets

HEAT DETECTOR INCLUDING DEVICE FOR DETECTING ABNORMALITY OF EXTERNAL TEMPERATURE SENSOR

BACKGROUND OF THE INVENTION

1. Field of the Invention

The present invention relates to a heat detector for use in a fire alarm system and the like.

2. Description of the Related Art

In a conventional heat detector, a thermistor is used as a temperature detection element for detecting ambient temperature around the heat detector. Several methods have been proposed to detect when the thermistor is operating abnormally or not. For example, when the thermistor has an open or is shorted, the output voltage of a temperature detection circuit changes substantially in comparison with the normal output voltage. When this detected output voltage is larger than a predetermined maximum value or smaller than a predetermined minimum value, it is determined that the thermistor has an open or has been shorted.

However, when the characteristics of the thermistor deteriorate due to change by aging, its resistance as measured at a constant temperature will change gradually, and thus the output voltage of the temperature detection circuit will not change abruptly. Such a gradual change in resistance of the thermistor due to the deterioration of its characteristics can not be detected by the conventional techniques.

When the temperature detection range of the heat detector has been set for example to a range higher than −10° C., it will be possible to assume that the deterioration of the thermistor has occurred if a low temperature such as −20° C. is detected. In this case, however, when the actual ambient temperature around the heat detector is for example +20° C., even if an incorrect value such as +10° C. or +30° C. is measured as a result of the deterioration of the thermistor, it is impossible to determine that the measuring result is incorrect. That is, the conventional technique suffers a drawback in that the deterioration of the thermistor can not be detected for the entire operation temperature range.

When an element such as a transistor or a diode other than a thermistor is used as the temperature detection element, a problem also arises in that the deterioration of the temperature detection element can not be detected for the entire operation temperature range.

SUMMARY OF THE INVENTION

An object of the present invention is to provide a heat detector in which the deterioration of the temperature detection element such as a thermistor may be reliably detected for the entire operation temperature range.

According to the present invention, a heat detector comprises: an external temperature detector for detecting the external temperature outside the heat detector; an internal temperature detector for detecting the internal temperature inside the heat detector; temperature difference calculation means for calculating the temperature difference between the external temperature detected by the external temperature detector and the internal temperature detected by the internal temperature detector; continuation time detection means for detecting that the temperature difference calculated by the temperature difference calculation means has remained greater than a predetermined value for a predetermined duration or longer; and determination means for determining that the external temperature detector is abnormal, if the continuation time detection means detects an event in which the temperature difference has remained greater than the predetermined value for the predetermined duration or longer, to output an abnormal signal.

In the heat detector according to the present invention, the temperature difference, between the external temperature detected by the external temperature detector and the internal temperature detected by the internal temperature detector, is detected. If this temperature difference has continuously exceeded the predetermined value for the predetermined duration or longer, then it is determined that the external temperature detector is abnormal. Thus, it is possible to reliably detect the deterioration of characteristics of the temperature detection element comprising, for example, a thermistor for the entire operation temperature range.

DESCRIPTION OF THE PREFERRED EMBODIMENTS

Preferred embodiment of the present invention will now be described with reference to the drawings.

Figure 1:
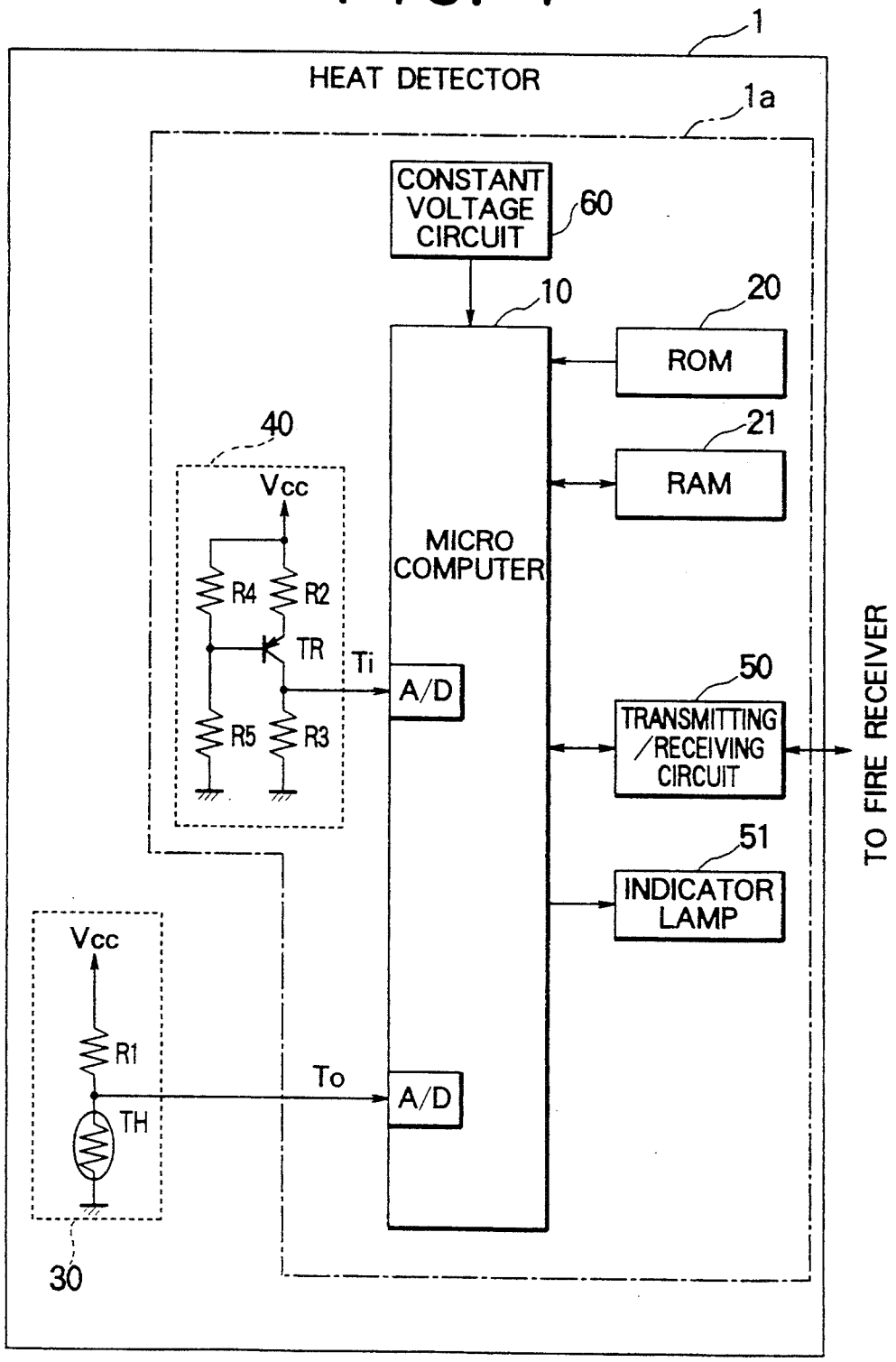
FIG. 1 is a block diagram illustrating a heat detector according to a first embodiment of the present invention.
Figure 2:
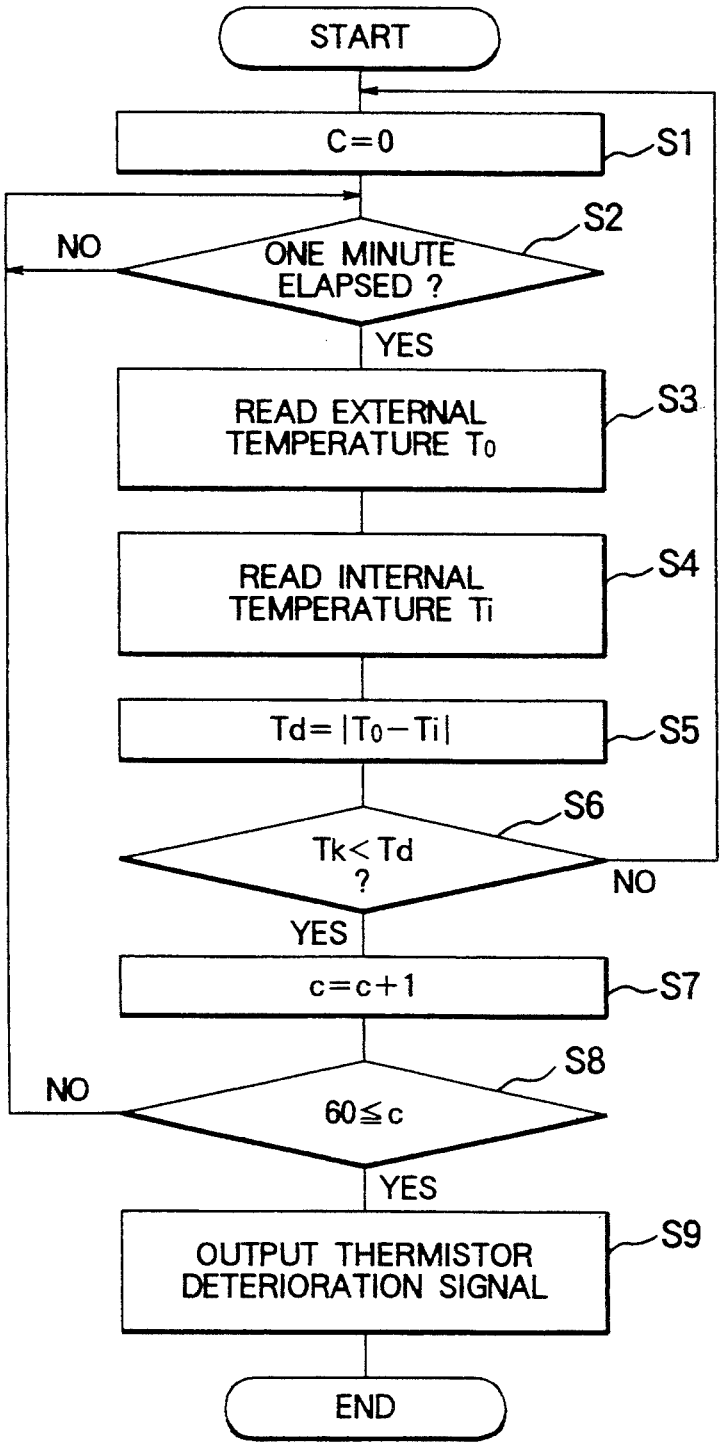
FIG. 2 is a flow chart showing the operation of a microcomputer in the first embodiment.
Figure 3:
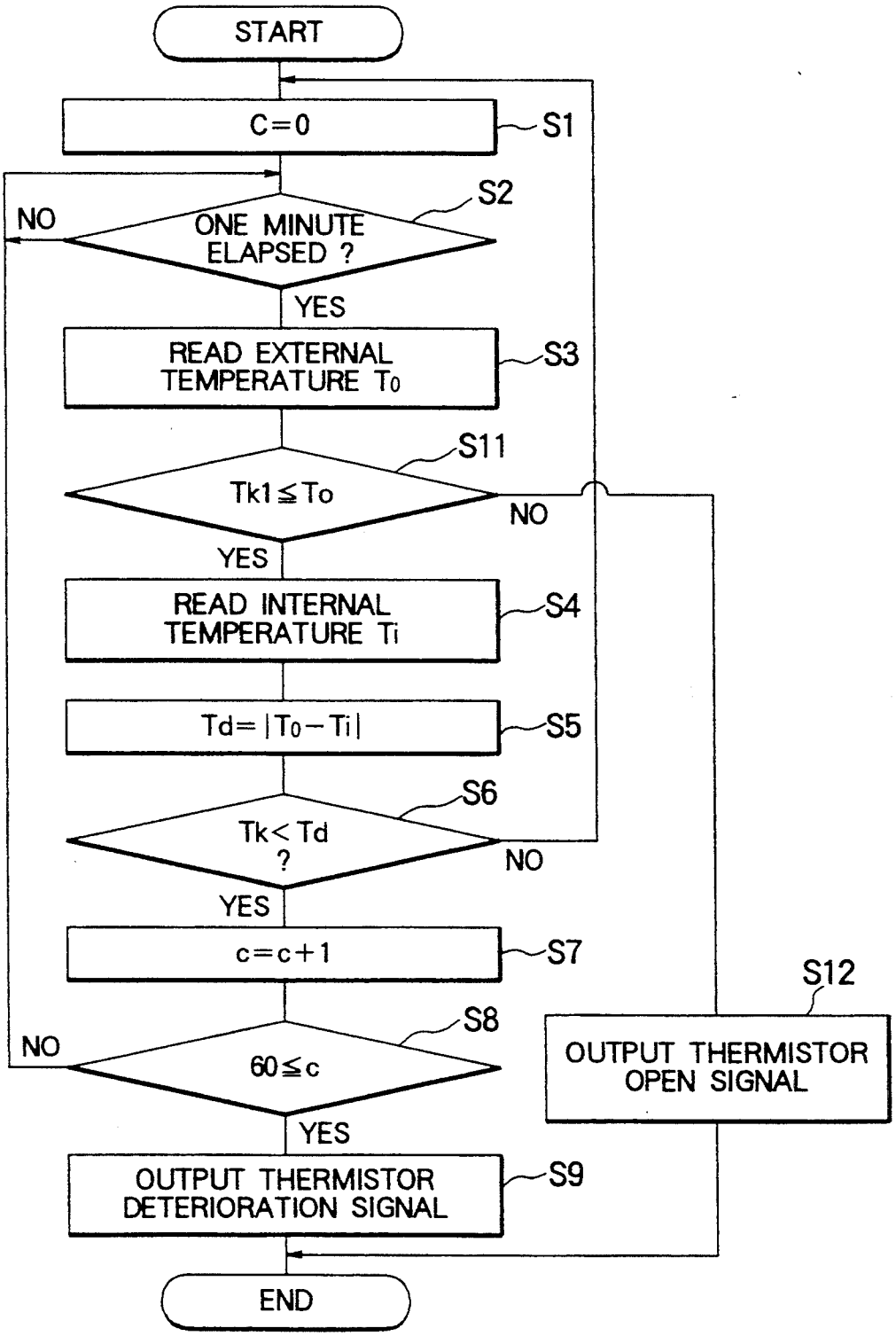
FIG. 3 is a flow chart illustrating a modified operation of the first embodiment.

First Embodiment:

Referring to FIG. 1, in a heat detector according to a first embodiment of the present invention, a microcomputer controls the entirely of the heat detector 1, and a ROM 20 stores a program according to the flow chart shown in FIG. 2 or 3. A RAM 21 is used as a working area.

An external temperature detector 30 for detecting the ambient temperature around the heat detector 1 is provided outside a case 1*a* of the heat detector 1. The external temperature detector 30 comprises a series circuit of a resistor R1 and a thermistor TH. In this external temperature detector 30, one end of the resistor R1 is connected to a power supply $V_{cc}$, while the other end of the resistor R1 is connected to one end of the thermistor TH. The other end of the thermistor TH is grounded. The connection point between the resistor R1 and the thermistor TH forms an output of the external temperature detector 30, which is connected to an input port of an A/D converter of the microcomputer 10.

An internal temperature detector 40 for detecting the internal temperature of the heat detector 1 is provided within the case 1*a* of the heat detector 1. The internal temperature detector 40 comprises a transistor TR and resistors R2 to R5 connected to the transistor TR. A PNP-type transistor is used as the transistor TR. The resistors R2 and R3 are used as an emitter resistor and a collector resistor, respectively. The resistors R4 and R5 provide a divided voltage to be supplied to the base of the transistor TR. The internal temperature detector 40 detects the internal temperature by using the temperature dependence of the base-emitter voltage $V_{BE}$ of the transistor TR. That is, the voltage $V_{BE}$ of the transistor TR has a temperature characteristic of −2 to −2.5 mV/°C., which is used to detect the internal temperature.

The microcomputer 10 calculates the temperature difference between the external temperature detected by the external temperature detector 30 and the internal temperature detected by the internal temperature detector 40. The microcomputer 10 monitors the temperature difference, and if the microcomputer 10 detects an event in which the temperature difference has continuously exceeded an allowable maximum value Tk for 60 minutes or longer, the microcomputer 10 determines that the external temperature detector 30 is abnormal.

A transmitting/receiving circuit 50 includes a transmitting circuit through which the microcomputer 10 transmits a signal such as a physical quantity signal representing heat to a fire receiver (not shown), and a receiving circuit through which the microcomputer 10 receives a signal such as a polling signal from the fire receiver. An indicator lamp 51 is turned on when the heat detector 1 shown in FIG. 1 detects the outbreak of a fire. A constant-voltage circuit 60 supplies a constant voltage to the microcomputer 10.

The ROM 20 stores a program required for the operation of the heat detector 1. The ROM 20 also stores the address of the heat detector 1, the allowable maximum temperature difference Tk, and the allowable lowest temperature Tkl. The RAM 21 stores temporally the external temperature To detected by the external temperature detector 30, the internal temperature Ti detected by the internal temperature detector 40, the temperature difference Td which is an absolute value of the difference between the detected external temperature To and the detected internal temperature Ti, and a count value c.

In the above-described configuration, the microcomputer 70 functions in multiple ways, that is, the microcomputer 70 is used as a temperature difference calculation means for calculating the temperature difference between the external temperature detected by the external temperature detector and the internal temperature detected by the internal temperature detector; the microcomputer 10 is also used as a continuation time detection means for detecting an event in which the temperature difference has continuously exceeded the predetermined value for the predetermined duration or longer; and furthermore, the microcomputer 10 is also used as a determination means for determining that the external temperature detector is abnormal when the temperature difference has exceeded the predetermined value for the continuous predetermined duration.

Now, the operation of the first embodiment will be described below.

FIG. 2 is a flow chart showing the process performed by the microcomputer 10 to determine an abnormality of the external temperature detector 30 according to the first embodiment.

The process begins at step S1 where the count value c is initialized to "0". After one minute has elapsed (step S2), the microcomputer 10 reads the external temperature To detected by the external temperature detector 30 (step S3). That is, when one minute has elapsed, the output voltage of the external temperature detector 30 is input to the input port of the A/D converter of the microcomputer 10. Then, the A/D converter converts this input analog data into digital data. This digital data is further converted into temperature data To, and the data To is stored in the RAM 21. The ROM 20 stores in advance a correspondence table for use in conversion of the digital data obtained by the A/D converter into the temperature data To.

Then, the microcomputer 10 also reads the internal temperature Ti detected by the internal temperature detector 40 (step S4). That is, the output voltage of the internal temperature detector 40 is input to the input port of the A/D converter of the microcomputer 10. Then, the A/D converter converts this input analog data into digital data. This digital data is further converted into temperature data Ti, and the data Ti is stored in the RAM 21. The ROM 20 also stores in advance a correspondence table for use in conversion of the digital data obtained by the A/D converter into the temperature data Ti.

The microcomputer 10 calculates the absolute value of the temperature difference Td between the detected external temperature To and the detected internal temperature Ti (step S5). Furthermore, the microcomputer 10 reads the allowable maximum temperature difference Tk from the ROM 20, and compares the temperature difference Td with the allowable maximum temperature difference Tk. If the temperature difference Td is greater than the allowable maximum temperature difference Tk, the count value c is incremented by "1" (steps S6 and S7). If the temperature difference Td is equal to or smaller than the allowable maximum temperature difference Tk, the process returns to step S1 where the count value c is reset to "0".

Then, the above-described operation (steps S1 through S7) is performed repeatedly. If the count value c reaches 60 as a result of this repeated operation (step S8), that is, if the temperature difference Td has remained greater than the allowable maximum temperature difference Tk for one hour or longer, the microcomputer 10 determines that deterioration has occurred in the thermistor TH, and outputs a thermistor deterioration signal indicating that deterioration has occurred in the thermistor TH (step S9). This thermistor deterioration signal is sent to the fire receiver via the transmitting/receiving circuit 50.

In the first embodiment as described above, if the temperature difference Td has remained greater than the allowable maximum temperature difference Tk for one hour or longer, the microcomputer 10 determines that deterioration has occurred in the thermistor TH. Therefore, it is possible to reliably detect a deterioration of the thermistor TH of the external temperature detector 30 for the entire operation temperature range. In the event of a fire, the external temperature To detected by the external temperature detector 30 will rise. However, in this case, the internal temperature Ti detected by the internal temperature detector 40 will also rise gradually, and thus the difference between the detected external temperature To and the detected internal temperature Ti will not become so great in one hour to prevent the microcomputer 10 from determining mistakenly that there is a deterioration in the thermistor TH. Thus, a fire can be reliably detected without mistakenly determining that the external temperature detector 30 is abnormal.

In step S5 of calculating the temperature difference Td, the absolute value of the temperature difference is used instead of a simple difference between the detected external temperature Td and the detected internal temperature Ti so as to reliably detect a deterioration of the thermistor TH for either case where the resistance of the thermistor TH increases or decreases due to the deterioration of the thermistor TH.

As for the transistor used in the internal temperature detector 40, an NPN-type transistor may be used instead of a PNP-type transistor TR.

FIG. 3 is a flow chart showing a modified operation of the first embodiment.

The process shown in this flow chart has additionally step S11 inserted between steps S3 and S4 of the flow chart shown in FIG. 2 with additional step S12, so that in this process it will be determined that the thermistor TH has an open in the event that the detected external temperature To is lower than the allowable lowest temperature Tkl (for example, −10° C.).

After reading the external temperature To detected by the external temperature detector 30 (step S3), the read external temperature To is stored in the RAM 21 and the allowable lowest temperature Tkl is read from the ROM 20. If the detected external temperature To is lower than the allowable lowest temperature Tkl (step S11), it is determined that the thermistor TH has an open, and a thermistor open signal is then output to the fire receiver via the transmitting/receiving circuit 50 (S12).

Figure 4:
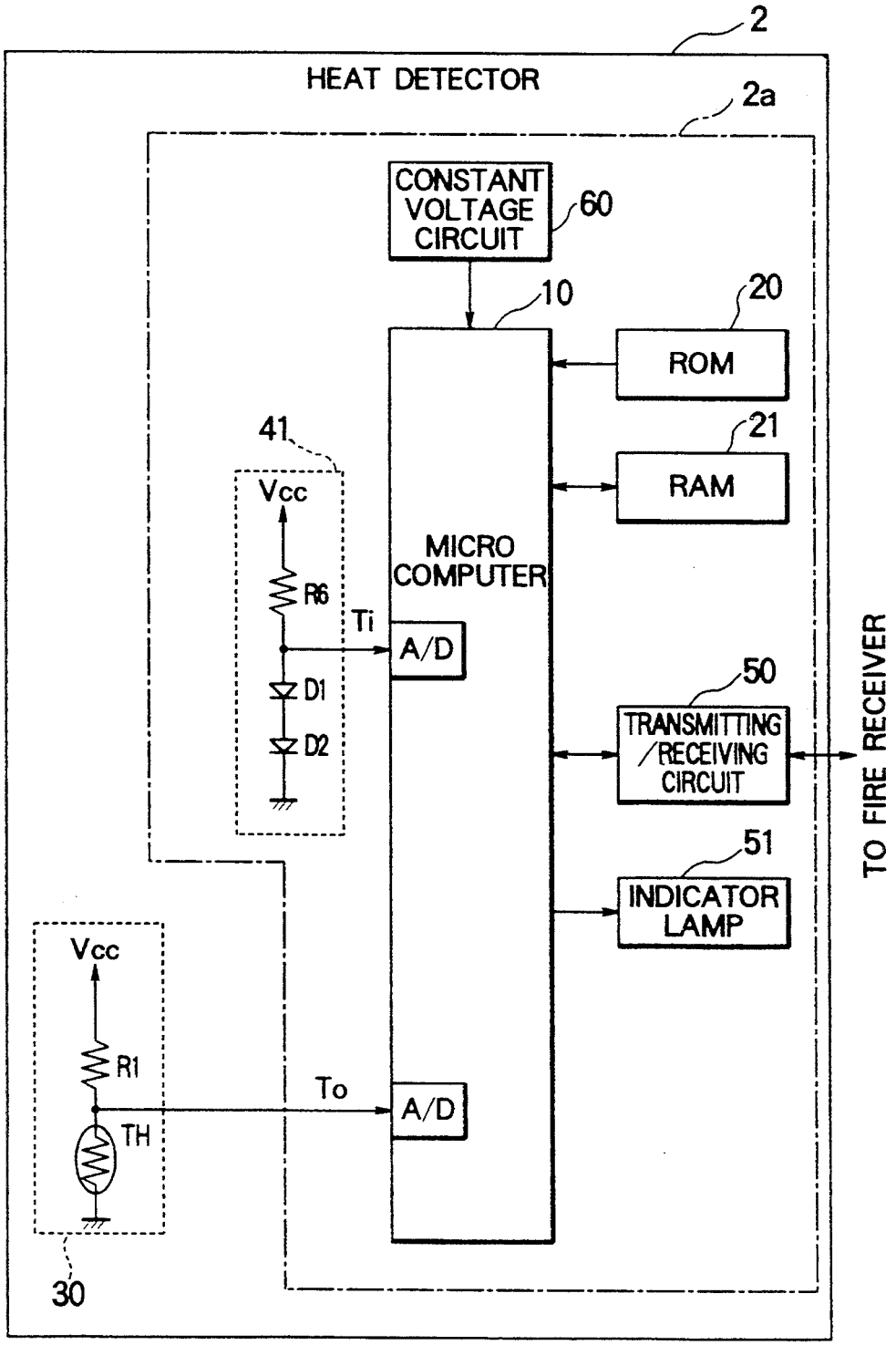
FIG. 4 is a block diagram illustrating a heat detector according to a second embodiment.

Second Embodiment:

FIG. 4 is a block diagram illustrating a heat detector 2 according to a second embodiment of the present invention.

The heat detector 2 shown in FIG. 4 has substantially the same configuration as that of the heat detector 1 shown in FIG. 1 except that the internal temperature detector 40 is replaced by an internal temperature detector 41.

The internal temperature detector 41 is used to detect the temperature inside a case 2*a* of the heat detector 2. The internal temperature detector 41 comprises diodes D1 and D2 disposed within the case 2*a*, and a resistor R6 connected in series to the diodes D1 and D2. One end of the resistor R6 is connected to a power supply $V_{cc}$, and the other end of the resistor R6 is connected to the anode of the diode D1. The cathode of the diode D1 is connected to the anode of the diode D2, the cathode of the diode D2 being grounded. The connection point between the other end of the resistor R6 and the anode of the diode D1 forms an output of the internal temperature detector 41. The internal temperature detector 41 detects the internal temperature of the heat detector 2 by using the temperature dependence of the voltage of the series circuit composed of the diodes D1 and D2.

In this second embodiment, the resistor R6 is connected to the power supply $V_{cc}$, and the series circuit of the diodes D1 and D2 is grounded. However, if the voltage of the power supply $V_{cc}$ does not change with temperature, the internal temperature detector 41 may also be configured such that the resistor R6 is grounded and the series circuit of the diodes D1 and D2 is connected to the power supply $V_{cc}$.

In the first and second embodiments described above, the detected external temperature To and internal temperature Ti are read every one minute. Alternatively, the detected external temperature To and internal temperature Ti may also be read every time duration other than one minute.

In the first and second embodiments, it is determined that there is a deterioration in the thermistor TH in the event that the temperature difference Td remained greater than the allowable maximum temperature difference Tk for one hour or longer. Alternatively, the determination that there is a deterioration in the thermistor TH may be made in the event that the temperature difference Td remained greater than the allowable maximum temperature difference Tk for a time duration other than one hour, for example two hours.

In each embodiment described above, the temperature detected by the external temperature detector 30 and the temperature detected by the internal temperature detector 40 or 41 are compared with each other. Alternatively, the voltage output from the external temperature detector 30 and the voltage output from the internal temperature detector 40 or 41 may be directly compared with each other.

In each embodiment described above, the thermistor TH is used in the external temperature detector 30. Alternatively, another type of temperature sensitive element such as a transistor or a diode may also be used instead of the thermistor TH.

Although it is not described in detail in the above embodiments, the microcomputer 10 reads the external temperature from the external temperature detector 30, for example, every 3 seconds, and transmits to the fire receiver via the transmitting/receiving circuit 50 a signal representing the detected temperature or the difference between the detected current temperature and the temperature which has been detected a predetermined time earlier, as well as a fire signal representing the result of a fire determination.

As described above, the present invention provides an advantage in that the deterioration of the characteristics of a temperature detection element such as a thermistor can be reliably detected for the entire operation temperature range.

What is claimed is:

1. A heat detector comprising:

a casing;

an external temperature detector located outside said casing for detecting an external temperature outside said casing;

an internal temperature detector located within said casing for detecting an internal temperature inside said casing;

processing means, operatively coupled to said external and internal temperature detectors, for calculating a temperature difference between the external temperature detected by said external temperature detector and the internal temperature detected by said internal temperature detector, for detecting when the thus calculated temperature difference has remained greater than a predetermined value for at least a predetermined duration, and for outputting an abnormality signal indicating that said external temperature detector is abnormal upon detecting that the calculated temperature difference has remained greater than the predetermined value for at least the predetermined duration.

2. A heat detector according to claim 1, wherein said processing means calculates an absolute value of the temperature difference between the external temperature and the internal temperature.

3. A heat detector according to claim 1, wherein said processing means is located within said casing.

4. A heat detector according to claim 1, wherein said external temperature detector includes a thermistor as a temperature detection element.

5. A heat detector according to claim 4, wherein said processing means is further for comparing the external temperature detected by said external temperature detector with an allowable lowest temperature, and for outputting a signal indicating that said external temperature detector has an open circuit upon detecting that the external temperature is lower than the allowable lowest temperature.

6. A heat detector according to claim 1, wherein said internal temperature detector includes a transistor as a temperature detection element and detects the internal temperature in accordance with a temperature characteristic of a base-mitter voltage of said transistor.

7. A heat detector according to claim 1, wherein said internal temperature detector includes a diode as a temperature detection element and detects the internal temperature in accordance with a temperature characteristic of a voltage of said diode.

8. A heat detector according to claim 1, further comprising output means for outputting a temperature signal representing the external temperature detected by said external temperature detector.

9. A heat detector according to claim 1, wherein said processing means determines the presence of a fire based on the external temperature detected by said external temperature detector and outputs a fire signal representing a determination result.

10. A heat detector according to claim 9, further comprising an indicator lamp which is lit when said processing means detects the presence of a fire.

* * * * *